US012692668B2

(12) United States Patent
Piller et al.

(10) Patent No.: US 12,692,668 B2
(45) Date of Patent: Jul. 28, 2026

(54) INITIAL AND FINAL METHODS FOR LAYING LONG RAILS

(71) Applicant: Matisa Materiel Industriel S.A., Crissier (CH)

(72) Inventors: Marco Piller, Hermenches (CH); Jacques Pilet, Vufflens-la-Ville (CH); Marc-Antoine Savoyat, Renens (CH); Milan Stupar, Prilly (CH); Alain Mundt, Crissier (CH)

(73) Assignee: Matisa Materiel Industriel S.A., Crissier (CH)

( * ) Notice: Subject to any disclaimer, the term of this patent is extended or adjusted under 35 U.S.C. 154(b) by 689 days.

(21) Appl. No.: 18/004,337

(22) PCT Filed: Jul. 8, 2021

(86) PCT No.: PCT/EP2021/069066
§ 371 (c)(1),
(2) Date: Jan. 5, 2023

(87) PCT Pub. No.: WO2022/008686
PCT Pub. Date: Jan. 13, 2022

(65) Prior Publication Data

US 2023/0279616 A1 Sep. 7, 2023

(30) Foreign Application Priority Data

Jul. 8, 2020 (FR) ..... 2007221

(51) Int. Cl.
*E01B 29/17* (2006.01)
*E01B 29/32* (2006.01)

(52) U.S. Cl.
CPC ..... *E01B 29/17* (2013.01); *E01B 29/32* (2013.01)

(58) Field of Classification Search
CPC ..... E01B 29/17; E01B 29/32
See application file for complete search history.

(56) References Cited

U.S. PATENT DOCUMENTS 10,676,873 B2 * 6/2020 Ganz ..... E01B 29/44
2018/0216299 A1 8/2018 Ganz

FOREIGN PATENT DOCUMENTS

GB 2311551 A * 10/1997 ..... E01B 11/54
WO 2007118977 A2 10/2007
WO 2014080118 A1 5/2014
WO 2017017600 A1 2/2017

OTHER PUBLICATIONS

International Search Report and Written Opinion mailed Sep. 24, 2021, in connection with International Patent Application No. PCT/EP2021/069066, 13 pgs. (including translation).

* cited by examiner

*Primary Examiner* — Robert J McCarry, Jr.
(74) *Attorney, Agent, or Firm* — Chiesa Shahinian & Giantomasi PC

(57) ABSTRACT

Disclosed is an initial method for laying new long rails of a railway track by means of a work train travelling in a direction of travel, the initial method being intended to be implemented during a process for replacing old rails of the railway track, said method including a phase during which the new long rails are laid and subsequently fastened to sleepers of the railway track when the work train is travelling in said direction of travel, the initial laying method including a step of laying at least one portion of a first of the new long rails on the sleepers at least one end of an old joining rail.

9 Claims, 5 Drawing Sheets

140
20
133
130
132
10
131
120
100
110

110
20

120
121
20

140
20

133
20
132
101
101
131
130

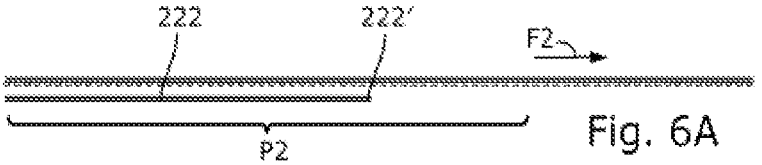
Fig. 6A
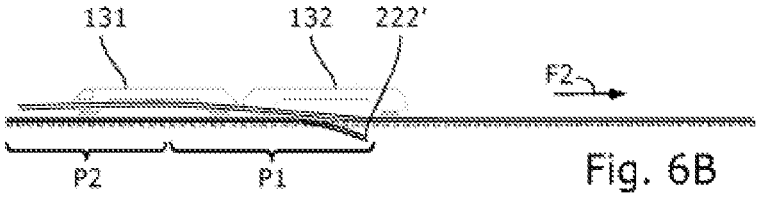
Fig. 6B
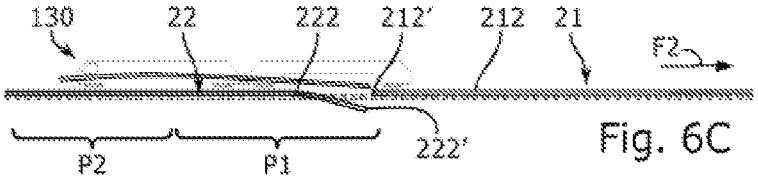
Fig. 6C
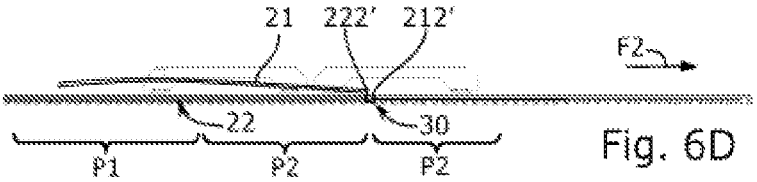
Fig. 6D
Fig. 6E
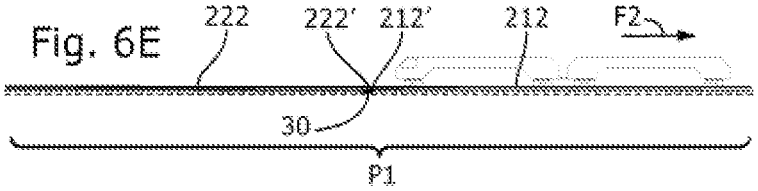
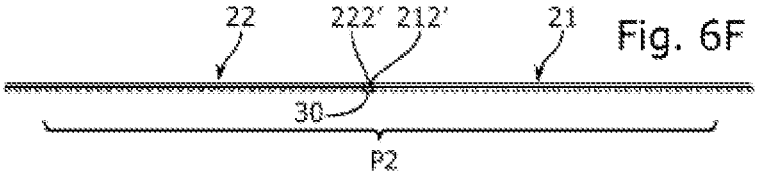
Fig. 6F

INITIAL AND FINAL METHODS FOR LAYING LONG RAILS

CROSS-REFERENCE TO RELATED APPLICATIONS

This application is a National Stage under 35 U.S.C. 371 of International Patent Application No. PCT/EP2021/069066, filed Jul. 8, 2021, which claims priority to French Patent Application No. 2007221, filed Jul. 8, 2020; the disclosures of all of which are incorporated herein by reference in their entirety.

TECHNICAL FIELD OF THE INVENTION

The invention relates, in a general manner, to the technical field of work trains such as construction and replacement trains, consisting in laying equipment necessary for the construction of railway tracks or, in the case of replacement, in replacing all or some of the materials making up the tracks, i.e. the rails and the fixed structure such as the sleepers, as well as the ballast which ensures the hold of the track on its platform, when these materials have deteriorated.

The invention relates more specifically to an initial laying method for new long rails of a railway track by a work train, a final laying method, and a method for replacing old rails, already laid, of a railway track with new long rails, which method is initiated and/or finalized by said initial and/or final laying methods for new long rails.

PRIOR ART

The builders or managers of rail transport networks need, on a regular basis, to construct new railway tracks or to re-do existing railway tracks, i.e., to replace some elements of which they are made up, such as the rails and the sleepers supporting the rails, as well as the fastening means and other accessories. A large part of this need of replacement is due to the wear of the tracks, but it can also be a case of replacing old models with more recent models in order to allow for better performance.

In the most complete case of replacement, such operations are performed using a rail convoy such as a replacing train, comprising a plurality of specialized machines for performing the different replacement operations. A typical operation of complete replacement of the railway track implements specialized rail convoys comprising machines capable of performing, in sequence, the following operations: unpacking, screening of ballast, and removal of unpacking products, by conveyor belts on cars intended for unloading, or by a direct jet to the embankment, replacement of the track to be replaced (rails and sleepers), ballasting and lifting of the track, levelling and shaping, welding of the rails, release of stresses, a new levelling/shaping, adjustment of seats, and tidying of verges.

The constant pursuit of safety and increased travel speed of rail vehicles has led to designs of rails referred to as "long welded rails" ("LWR"), or "long bars." In the particular case of replacing rails, the replacement operation consists in replacing old rails with new long rails without interfering with the other elements of the track (platform, ballast, sleepers). It typically involves the implementation of the following steps:

- supplying new rails of the "LVW" types, in the form of "long bars" (for example 324 meters), previously made in welding workshops a distance from the works site, from basic rails (for example three basic rails of 108 meters each), originating from rail manufacturing factories,
- removal of ties and sectioning of old rails,
- removal of old rails, placement and alignment of new rails end-to-end, thermite welding of the new rails to one another, placed end-to-end, fastening of the new rails to the sleepers,
- connection of the new rails to the existing line by thermite welding, release of stresses (releasing of the ties of the new rails, striking, re-tightening of the ties), neutralizing of the rail, if necessary, using a rail driftpin, heating using gas or another method depending on the temperature at the time of substitution,
- loading and removal of the old rails, and cleaning of the works site.

On a track equipped with "normal" bars, the expansion is absorbed in the region of rail joints, a precisely regulated clearance between two consecutive bars allowing for a slight extension of the rails. Such a track is thus relatively insensitive to temperature variations. This is not the case for a track equipped with long bars or "LWR," because in this case there are no joints between the rails which allow for the expansion to be absorbed. The clamping of the rail onto the sleepers, and the anchoring of the sleepers in the ballast, counter the free movement of the rails under the effect of temperature variations. Since the expansion of the rail is thwarted, it is compensated by an increase in the internal stresses of the rail. When the resistance of the ballast is no longer sufficient to counter the internal stresses of the rail, the rail thus ends up stretching, thus creating a deformation of the geometry of the chassis of the track, Such deformations of the track are obviously extremely dangerous.

In order to considerably reduce the risks of rupture of said rails due to cold weather, or deformation due to extreme heat, it is known to perform an operation of "neutralizing" the new rails. Said neutralizing makes it possible to fasten the rails at a given expansion state, either at a specified average temperature (for example 25° C.) when the neutralizing takes place by heating the rails, or with stretching of the rails corresponding to their expansion at this average temperature when the neutralizing operation is carried out by stretching of the rails.

All these operations performed step-by-step, per portion of the rails, rail after rail or long bar after long bar, require a significant amount of time as well as an interruption in travel. The same operations are required during laying of a new track, with the exception, of course, of the dismantling of the old ties and the removal of the old rails.

Solutions capable of implementing rail replacement operations comprising a step of neutralizing the rails, but at relatively low speeds, indeed which are not suitable for replacing rails for laying long welded rails, have long been known. Other existing solutions require the use of a plurality of different rail convoys for each implementing just one part of the replacement operations, which proves expensive. Furthermore, such replacement works are very long and require a larger labor force. Finally, when such solutions propose neutralizing the rail, said neutralizing proves non-existent at the ends of new rails connected to the old railway track or performed in a traditional manner using separate means.

DISCLOSURE OF THE INVENTION

The invention aims to overcome all or some of the disadvantages of the prior art by proposing in particular a solution which makes it possible to implement a method for replacing old rails by new long rails, offering the shortest possible downtime of the railway track in order to reduce the duration of the work, while ensuring good safety of the laid railway track, in particular at the ends of the old rails surrounding a portion of the rail to be replaced, corresponding to the ends of new rails connected to the old railway track.

In order to achieve this, according to a first aspect of the invention an initial method for laying new long rails of a railway track by means of a work train travelling in a direction of travel is proposed, the initial method being intended to be implemented during a process for replacing old rails of the railway track of the type comprising a phase during which the new long rails are laid and subsequently fastened to a fixed structure of the railway track when the work train is travelling in said direction of travel, the initial laying method comprising:

- a step of laying at least one portion of a first of the new long rails on the fixed structure at at least one end of an old joining rail;
- a temporary end-to-end connection step for connecting the end of the old joining rail to at least one end of the first new long rail by means of at least one temporary connection device;
- a step of permanent connection, for example by welding, for example therrnite welding, of the two connected ends of the old joining rail and the first new long rail;
- the initial laying method being characterized in that it comprises, prior to the laying step, a step of heating or cooling, for neutralizing to the reference temperature, at least one end portion of the first new long rail, the end portion comprising the end of the first new long rail to which the end of the old joining rail is required to be connected.

"Long rails" means rails also referred to as "long welded rails" ("LWR") or "long bars." These long welded rails are formed from one or from a plurality of basic rails of normal length, or "normal bars," welded together, generally in welding workshops a distance from the works site, and thus forming a single continuous unit. The distinction between long welded rails and rails consisting of normal bars is thus very clear in terms of length, it being possible for the long welded rails to extend over several hundred meters, or indeed kilometers. In this case, the railway track refers both to tracks laid on ballast, or tracks without ballast laid on other supports (tracks laid on concrete, tracks laid on slabs, etc.). The fixed structure of the railway track may vary in function and comprise for example, depending on the type of railway track, sleepers, slabs, a concrete platform, etc.

By virtue of such a combination of features, a method of this kind allows for a connection between the old railway track and the new railway track, with a level of safety that is guaranteed by neutralizing the rails, prior to fastening them, in a manner equivalent to the remainder of the track, in particular in this case in the region of the end portion of the first new long rail. Of course, the initial laying method may be implemented on a line of rails of the railway track, or indeed concurrently on the two parallel lines of rails of the railway track.

According to one embodiment, the initial laying method comprises a step of neutralizing, preferably by heating or cooling, an end portion of the old joining rail comprising the end of the old joining rail to which the end portion of the first new long rail is required to be connected.

According to one embodiment, the step of heating or cooling for neutralizing, to the reference temperature, the end portion of the first new long rail is preceded by the step of neutralizing, preferably by heating or cooling, the end portion of the old joining rail comprising the end of the old joining rail to which the end portion of the first new long rail is required to be connected.

According to one embodiment, the step of heating or cooling for neutralizing the end portion of the old joining rail is performed by heat transfer or insulation means which preferably comprise an infrared radiation source for heating said end portion of the old joining rail to the reference temperature.

According to one embodiment, prior to the step of end-to-end connection of the end of the old joining rail to the end of the first new long rail by the temporary connection device, a step of cutting the old joining rail is performed, in order to form the end of the old joining rail which is to be connected.

According to one embodiment, the temporary connection device comprises at least one fishplate or rail driftpin. The temporary connection devices such as the fishplate or the rail driftpin have the function of keeping the ends of the rails abutted, whatever the outside temperature variations, in order to thus guarantee the perfect joining of the ends. Another function is to retain the reference length of the old and of the new rail, until the step of welding the ends. Said temporary connection device is removed once the ends of the rails are welded, and once the weld has cooled after a predetermined cooling time, generally twenty minutes. The permanent connection, subsequent to the temporary connection, makes it possible to ensure travel at a normal speed, of a rail vehicle, while the temporary connection allows, at best, for travel at a reduced speed.

According to one embodiment, prior to or following the step of temporary end-to-end connection of the end of the old joining rail to the end of the first new long rail by the temporary connection device, said ends undergoing a preparation step in view of the permanent connection step, for example a step of abrasive machining.

According to another aspect of the invention, this relates to a final method for laying new long rails of a railway track by means of a work train travelling in a direction of travel, the final method being intended to be implemented during a process for replacing old rails of the railway track of the type comprising a phase during which the new long rails are laid and subsequently fastened to a fixed structure of the railway track when the work train is travelling in said direction of travel, the final laying method comprising:

- a step of laying at least one portion of a last of the new long rails on the fixed structure at at least one end of an old joining rail;
- a temporary end-to-end connection step for connecting an end of the last new long rail to at least the end of the old joining rail by means of at least one temporary connection device;
- a step of permanent connection, for example by welding, for example therrnite welding, of the two connected ends of the old joining rail and the last new long rail;
- the final laying method being characterized in that it comprises, prior to the laying step, a step of heating or cooling, for neutralizing, to the reference temperature, at least one end portion of the last new long rail, the end portion comprising the end of the last new long rail to which the end of the old joining rail is required to be connected.

According to one embodiment, the final laying method comprises a step of neutralizing, preferably by heating or cooling, an end portion of the old joining rail comprising the end of the old joining rail to which the end portion of the first new long rail is required to be connected.

According to one embodiment, the step of heating or cooling for neutralizing, to the reference temperature, the end portion of the last new long rail is followed by the step of neutralizing, preferably by heating or cooling, the end portion of the old joining rail comprising the end of the old joining rail to which the end portion of the last new long rail is required to be connected.

The steps implemented, and the means used for this final method are similar, mutatis mutandis, to the initial method. Thus, and in the same way as for the end portion of the first new long rail, a method of this kind allows for a connection between the old railway track and the new railway track, with a level of safety that is guaranteed by neutralizing the rails, prior to fastening them, in a manner comparable to the remainder of the track, in particular in this case in the region of the end portion of the last new long rail.

According to another aspect, the invention also relates to a method for replacing old rails of a railway track of the type comprising a phase during which the new long rails are laid and subsequently fastened to a fixed structure of the railway track by a work train travelling in a direction of travel, the replacement method being characterized in that the phase is initiated by the initial method for laying new long rails as described above, and/or finalized by the final method for laying new long rails as described above.

According to one embodiment, the replacement method comprises a first phase during which new long rails are unloaded along the railway track from a transport train of a work train travelling in a first direction of travel, and comprises a second phase in which the work train travels in a second direction of travel opposite the first direction of travel, the new long rails being laid and subsequently fastened on the fixed structure, such as the sleepers of the railway track, during the second phase.

A replacement method of this kind can be implemented by one single work train. Furthermore, the operations performed can be sequenced in an optimized manner. It is no longer necessary to perform all the operations at the same time, or in a manner sequenced successively according to a single direction of travel, which would have the effect of reducing the speed of travel on the works site, depending on the most restrictive operation. Indeed, when the work train implements all the operations in series, just one operation requiring the immobilization of the work train is sufficient to limit the progression of the work regarding the other operations. Proceeding in a sequenced manner of this kind, in two phases, and distributing the replacement operations in one direction of travel and then in the other direction of travel, a reduction in the works time for an equivalent length of replaced rails has been identified. Finally, it is possible to perform all these operations during the same temporary interruption of travel, while minimizing the duration of this interruption.

According to one embodiment, the work train comprises vehicles mounted on wheel sets, for example bogies, the step of neutralizing by heating or cooling for neutralizing being performed in a zone of the work train located upstream of the first of the wheel sets of the work train, with respect to the new long rails, in relation to the second direction of travel.

According to one embodiment, the heating or cooling neutralizing step is followed by a step of holding and/or correction of the reference temperature of the neutralized portion of rail, by heat transfer or insulation, the step of holding and/or correction of the reference temperature preferably being carried out in a zone of the work train located at least downstream of the first of the wheel sets with respect to the new long rails, in relation to the second direction of travel. Preferably, the heat transfer or insulation means comprise an infrared radiation source. During a step of holding and/or correction of the reference state, the holding means can ensure a correction of the neutralization, in addition to said neutralizing step, so as, for example, to aim towards a reference state which would not have been achieved during the previous neutralizing step.

Once the new long rails are laid on the fixed structure, a certain distance separates the laying zone of said rails from a fastening zone of said rails to the fixed structure. Such a step of holding and/or correction of the reference state, for example the reference temperature, downstream in reference to the second direction of travel and at a distance from the neutralizing step, makes it possible to ensure fixing of the neutralized new long rails, in particular at a temperature that is held at the reference temperature. This makes it possible to further reduce the risks of said rails breaking or of the track deforming according to the heat differences to which they are exposed.

The initial method is an initial or engagement phase of the steps of laying the new long rails and dismantling the old rails by the work train, in order to start the replacement, proceeding from this initial configuration, of a portion of the railway track.

Preferably, the neutralizing during the initial laying method for the end portion of the old joining rail is performed by all or some of the means for holding and/or correcting the reference temperature.

The final method is a final or disengagement phase of the steps of laying the new long rails and dismantling the old rails by the work train, in order to finalize the replacement of a portion of the railway track.

Preferably, the neutralizing during the final laying method for the end portion of the old joining rail is performed by all or some of the means for holding and/or correcting the reference state.

BRIEF DESCRIPTION OF THE FIGURES

Other features and advantages of the invention will become clear from the following description, given with reference to the accompanying drawings, in which:

FIG. 6A is a schematic view of a step of a final phase of the second phase of the replacement method according to this embodiment;

FIG. 6B is a schematic view of a step of the final phase of the second phase of the replacement method, after that of FIG. 6A;

FIG. 6C is a schematic view of a step of the final phase of the second phase of the replacement method, after that of FIG. 6B;

FIG. 6D is a schematic view of a step of the final phase of the second phase of the replacement method, after that of FIG. 6C;

FIG. 6E is a schematic view of a step of the final phase of the second phase of the replacement method, after that of FIG. 6D;

FIG. 6F is a schematic view of a step of the final phase of the second phase of the replacement method, after that of FIG. 6E;

For reasons of improved clarity, the identical or similar elements are indicated by identical reference signs in all the figures.

DETAILED DESCRIPTION OF AN EMBODIMENT

Figures 1, 2A, 2B, 2C, 2D:
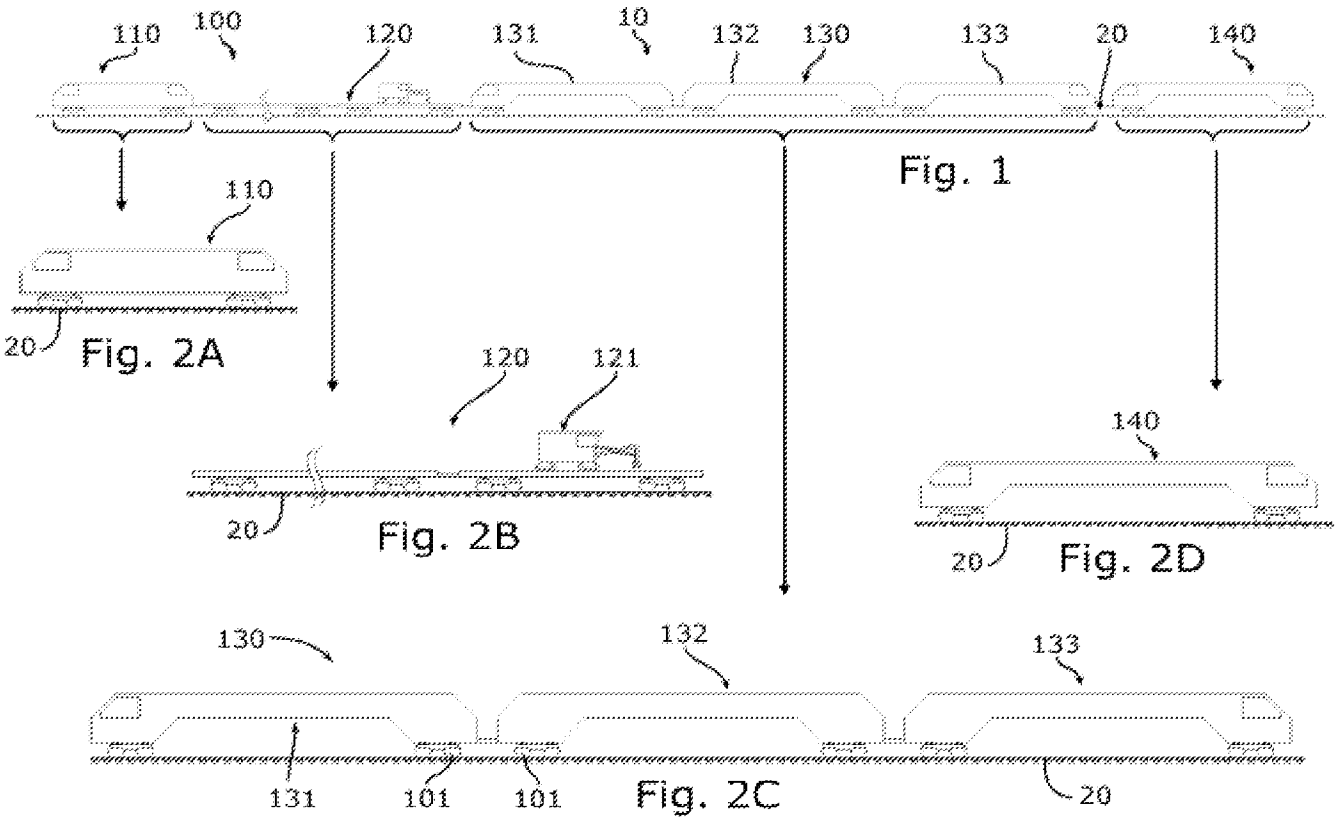
FIG. 1 is a schematic view of a rail convoy comprising a work train according to an embodiment of the invention.
FIG. 2A is a schematic detail of FIG. 1.
FIG. 2B is a schematic detail of FIG. 1.
FIG. 2C is a schematic detail of FIG. 1.
FIG. 2D is a schematic detail of FIG. 1.

FIGS. 1, 2A, 2B, 2C and 2D are schematic views of a rail convoy 10 comprising a work train 100 according to an embodiment of the invention. The work train 100 comprises an engine 110 at the front of the train, followed, in this case directly, by a transport train 120 coupled to the engine 110. The transport train 120 is designed to ensure the transport of new long rails 22 to be transported on a works zone Z0, and preferably also to store old rails 21 to be removed from this same works zone Z0, as the new long rails 22 are laid. The work train 100 comprises a works train 130 coupled to the rear of the transport train 120. The works train 130 is illustrated in a variant equipped with three works vehicles 131, 132, 133 coupled successively, in particular a first works vehicle 131, a second works vehicle 132, and a third works vehicle 133. It is of a variable composition, i.e. its composition of cars may vary at points, for example when passing into a workshop, but which, once specified, generally for a specific works site, does not change any more apart from when passing into a workshop.

It will be noted that the "old" rails extend in the manner of rails already laid, pre-existing on a track to be replaced, the new rails extending in the manner of rails coming to replace said rails already laid. These terms do not indicate the wear or aging of the rail per se.

The rail convoy 10 comprises a welding machine 140, which is in this case a railway machine which can be detachably coupled at the end of the work train 100, in particular here at the end of the works train 130, in relation to a first direction of travel F1. Such coupling makes it possible to move a rail convoy as far as the works zone Z0. The welding machine 140 is intended to be uncoupled from the work train 100 once it has arrived in the vicinity of the works zone Z0, as shown in FIG. 1, so as to be able to travel independently of the work train 100, preferably at a distance from the work train 100, Its use will be better understood upon reading the replacement method described below.

Figure 3A:
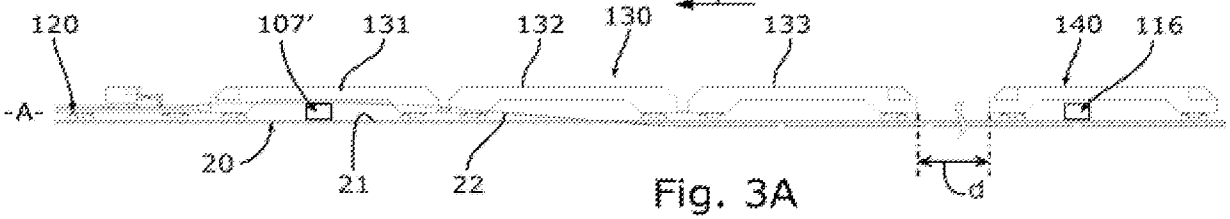
FIG. 3A is a schematic view of the rail convoy as shown in FIG. 1, during a first phase of a replacement method according to this embodiment.
Figure 3B:
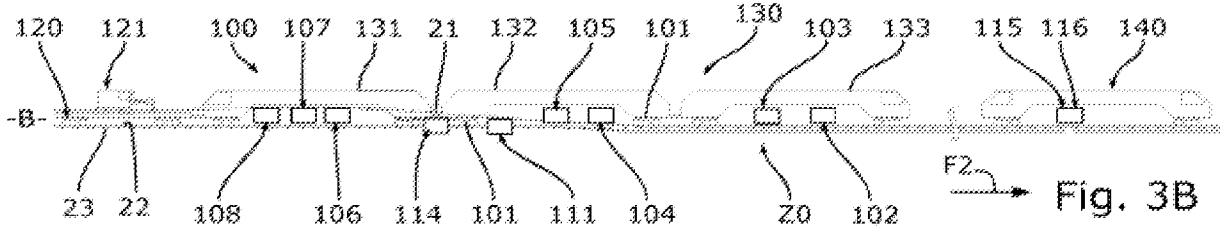
FIG. 3B is a schematic view of the rail convoy as shown in FIG. 1, during a second phase of a replacement method according to this embodiment.

FIGS. 3A and 3B are schematic views of said rail convoy 10, in a first and a second phase A, B, respectively, of the replacement of the railway track 20—this is the replacement of the old rails 21 of the railway track 20 with new long rails 22. The method for replacing old rails 21 of the railway track 20 with new long rails 22 is made up, overall, of:

- a first phase A during which new long rails 22 are unloaded along the railway track 20 from the transport train 120 of the work train 100 travelling in a first direction of travel F1, and
- a second phase B during which the work train travels on a reverse path, i.e. in a second direction of travel F2 opposite the first direction of travel F1, and during which the new long rails 22 are laid and subsequently fastened on a fixed structure 23, of the railway track 20, in this case sleepers 23.

In other words, the work train 100 moves on the railway track 20 in two phases, out A and back B, during which it implements different steps, the combination of these two phases A and B making it possible to ensure the replacement of the railway track 20.

During the first phase A, the new long rails 22 are unloaded successively along the railway track 20, from the transport train 120 of the work train 100, while the work train advances according to the first direction of travel F1 drawn by the engine 110. The engine 110 may selectively provide, or not, a traction aid for the work train 100, which is equipped with its own advancement system, in particular by distributed driving wheel sets. Thus, the delivery onto the works site can be carried out according to two variants: using a self-propelled machine specific to the work train, or by being towed by a locomotive. On the works site, the self-propelled machine can also be assisted by a traction ensured by the locomotive.

Depending on the desired configuration, these new long rails 22 can be unloaded outside of the railway track 20, along old rails 21 to be replaced, or in the center of the railway track 20. Once the first phase A is ended, this results in an alignment of new long rails to be laid, arranged successively along the railway track 20 and in the vicinity thereof. A step of placement on the ground of supports, such as roller supports, is implemented prior to the unloading of the new long rails, preferably by one of the vehicles of the works train 130, such that the new long rails come to rest, on the ground, on these roller supports, and not directly on the ground or the ballast. The station 107' designed to ensure the laying or placement of roller supports is located upstream of that of the unloading of the new long rails 22, with reference to said first direction of travel F1. In this example, the work station 107' ensuring the placement of the roller supports is implemented by the first vehicle 131 of the works train, in front of the second vehicle 132 in the region of which the unloading is ensured, with reference to said first direction of travel F1.

In parallel with this operation of unloading of the new long rails 22 along the railway track 20, still during the first phase A, each of the ends of the new long rails 22 unloaded undergoes a step of preparation with a view to a step of permanent connection, for example welding. Such a preparation step comprises, for example, a step of abrasive machining. Said step of preparation for the welding is implemented by a welding preparation post 116 borne by the welding machine 140. In this example, said welding machine 140 is a railway machine. In particular configurations, the welding machine could also be a welding rail-road truck or a welding rail-road excavator. The welding machine 140 travels independently of the work train 100 and in the first direction of travel F1, behind it. During the first phase A, the welding machine 140 thus travels generally in the same direction F1 as the work train 100, at a distance d behind it, said distance being variable during the first phase A. In this way, while the work train 100 progresses at a virtually continuous and homogeneous speed for unloading the new long rails 22, with some short breaks, so as to guide the new long rails 22 towards a laying zone of the train, said breaks marking stages A3 in the progression of the work (see FIG. 7), the welding machine 140 progresses at a different speed and in a sequenced manner, alternating static phases, during the preparation for the welding of the ends of the new long rails 22, and dynamic phases where it progresses along the railway track 20 in order to reach a following end, and so on.

During the second phase B, the work train moves according to a second direction of travel F2 opposite the first direction of travel F1, thus travelling the reverse path. The rail convoy 10 comprises, successively, from the front to the rear with respect to the first direction of travel F1, the locomotive 110 (which is optional if it is not used as a traction aid during the work), then the transport train 120 and the works train 130 then travel in a reverse order—the works train 130 is positioned at the front of the work train 100, with reference to this second direction of travel F2. The welding machine 140 which traveled independently and at a distance behind the work train during the first phase A still travels independently and at a distance from the work train 100 during the second phase B, but this time in front of it, with reference to said second direction of travel F2.

A plurality of operations are implemented substantially concurrently during said second phase B.

The old rails 21 of the portion of railway track to be replaced are dismantled by the work train 100, then preferably loaded onto the transport train 120 of the work train 100. The old rails 21 are coupled at regular intervals while they are loaded on the transport train 120 of the work train 100 in order to be stored in a plurality of separate sections of old rails 21. In this way, the transport train 120 can be used to store both the new long rails 22 and the old rails 21. Another possible alternative is that the old rails 21 are moved along the railway track 20 from the railway track 20 itself, in particular from their location on the sleepers 23, The transport train 120 is provided with handling equipment 121 such as handling frame which makes it possible to ensure a certain number of operations, such as the cutting of the old rails 21, or the gripping of the rails 21, 22, etc. Alternatively, or in addition, these operations can also be carried out entirely or partially manually. The loading path of the old rails 21 preferably follows the reverse path of that of the unloading of the new rails 22, In this way, the multiplication of equipment, in particular on the second vehicle 132 of the works train 130, is limited.

The welding machine 140, which thus travels, during said second phase, in front of the work train 100 and in the same direction of travel F2 as the work train, comprises welding means 115 and in turn carries out welding operations, preferably electric welding, of the new long rails 22, end-to-end. The welding machine 140 operates at a sufficient distance from the work train 100 so as to allow for the cooling of the electric weld before the laying of the new long rail 22. A cooling time on the order of for example 20 minutes can thus be ensured.

The laying of the new long rails 22 on the sleepers 23 of the railway track 20 is ensured by the work train 100 in the region of a laying zone Z1 located downstream of the welding machine 140, This laying operation consists in particular, but not exclusively, of moving the new long rails 22 arranged along the railway track 20, in order to install them on the sleepers 23, in the same place where the old rails 21 are previously dismantled, said dismantling taking place in a dismantling zone Z6 which is upstream with respect to the laying zone Z1 The dismantling of the old rails 21 and the laying of the new long rails 22 are carried out in parallel, and thus progress in a synchronized manner. The same vehicle 132 of the works train 130 mainly implements the dismantling and laying steps, such that the laying Z1 and dismantling zones Z6 are located perpendicularly to the same vehicle 132 of the works train 130, said steps being implemented by the same second vehicle 132. In this way, the discontinuity of the railway track 20 brought about by the dismantling of the old rails 21 and the laying of the new long rails 22 is spanned by the same vehicle 132 borne by a wheel set such as an upstream bogie 101 with respect to the second direction of travel F2, moving on the old rails 21, and a wheel set such as a downstream bogie 101 moving on the new long rails 22 positioned on the sleepers 23. Said downstream bogie 101 of the vehicle 132 implementing these two steps constitutes the first of the bogies 101 of the work train 100 with respect to the new long rails 22, in relation to the second direction of travel F2.

A step of neutralizing, by portions 24, the new long rails 22 by heating or cooling to a reference temperature is implemented in order to allow fastening of the rails at a given dilation reference state. During said neutralizing step, located in a zone Z2 (see FIG. 4), each of the portions 24 of the new long rails 22 is heated or cooled to the reference temperature by main neutralizing means 111 located in the same zone Z2 before being laid on the sleepers 23 of the railway track 20. The main neutralizing means 111 preferably comprise a heating means, such as an induction heating means. Preferably, the main neutralizing means 111 comprise cooling means, for example equipment for projecting a flow of liquid such as water or a gas flow, ideally air, optionally compressed, dry ice, etc.

Said neutralizing zone Z2 is located upstream of the first of the wheel sets, in particular in this case bogies, 101 of the work train 100 with respect to the new long rails 22, in relation to the second direction of travel F2.

In order to avoid too significant a temperature difference between the reference temperature and the temperature of the rails at the time of their fastening to the sleepers 23, the heating or cooling neutralizing step is followed by a step of holding and/or correction of the reference temperature of the neutralized portion of rail 24, by heat transfer or insulation. Preferably, the heat transfer or insulation means comprise an infrared radiation source.

Said step of holding and/or correction of the reference temperature is carried out in a zone Z3 of the work train 100 located at least downstream of the neutralizing zone Z2 and downstream of the first of the bogies 101 with respect to the new long rails 22, in relation to the second direction of travel F2. In a variant shown in FIG. 4, said zone Z3 continues downstream of the second bogie with respect to the new rails. The new long rails 22 are then fastened to the sleepers 23 by ties in a zone Z4 of the work train 100 located directly downstream of the zone Z3 of the work train in which the step of holding and/or correction of the reference temperature is carried out. Said step of holding and/or correction of the reference state, i.e., the reference temperature, is implemented by at least holding and/or correction means 113 of the reference temperature, located in the region of said same zone Z3.

Figure 4:
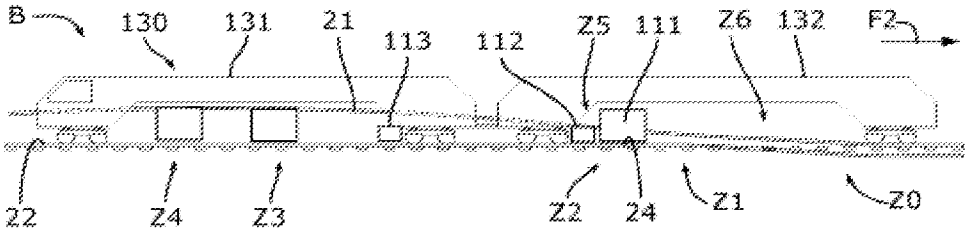
FIG. 4 is a schematic detail of FIG. 3B.
Figure 5A:
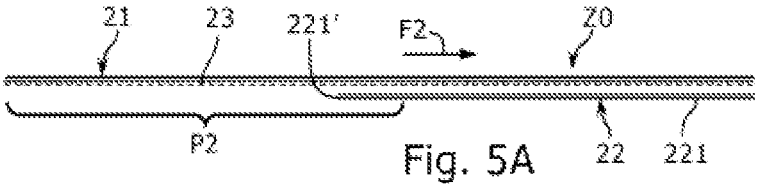
FIG. 5A is a schematic view of a step of an initial phase of the second phase of the replacement method according to this embodiment.
Figure 5B:
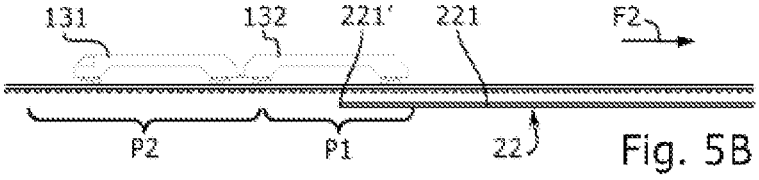
FIG. 5B is a schematic view of a step of the initial phase of the second phase of the replacement method, after that of FIG. 5A.
Figure 5C:
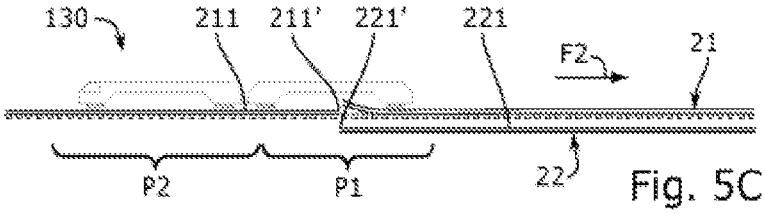
FIG. 5C is a schematic view of a step of the initial phase of the second phase of the replacement method, after that of FIG. 5B.
Figure 5D:
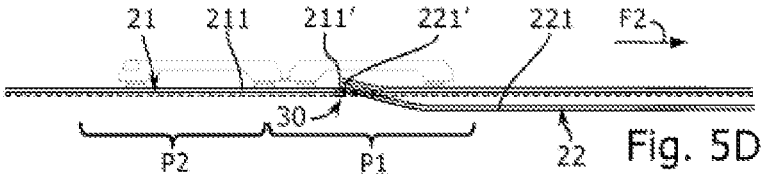
FIG. 5D is a schematic view of a step of the initial phase of the second phase of the replacement method, after that of FIG. 5C.
Figure 5E:
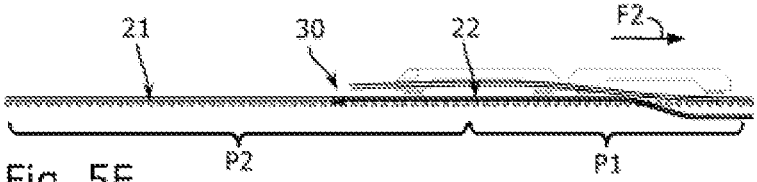
FIG. 5E is a schematic view of a step of the initial phase of the second phase of the replacement method, after that of FIG. 5D.
Figure 5F:
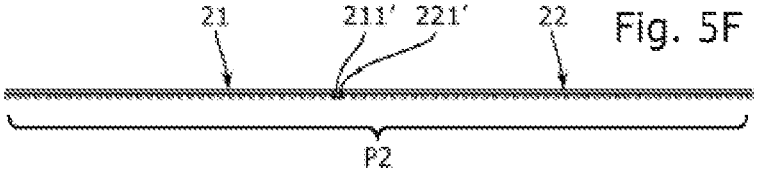
FIG. 5F is a schematic view of a step of the initial phase of the second phase of the replacement method, after that of FIG. 5E.

Of course, an additional step of holding and/or correction of the reference temperature of the neutralized rail portion 24 by heat transfer or insulation can be implemented on another holding and/or correction zone Z5 of the upstream reference temperature, for example by additional holding and/or correction means 112 of the reference temperature, upstream of the first bogies 101 with respect to the new long rails 22, and downstream of the neutralizing zone Z2 (see FIG. 4). Indeed, a notable distance separates the main neutralizing means 111 of the first of the bogies 101 with respect to the new long rails 22, approximately 8 m in this embodiment, which justifies the interest in such an additional device for holding and/or correction 112 of the upstream reference temperature. Of course other additional holding means for the reference temperature can be used, such as additional holding and/or correction means 114 of the reference temperature which are located between the means 113 and 112, in the region of the first and second bogies 101 with respect to the new long rails 22 the first of the bogies 101 with respect to the new long rails 22 forming the downstream bogie of the second vehicle 132, and the second of the bogies 101 with respect to the new long rails 22 forming the upstream bogie of the first vehicle 131 which precedes it with reference to the second direction of travel F2.

Ideally, the step of holding and/or correction of the reference step is implemented over the entire portion of rail located between its neutralizing and its fastening, the fastening of ties being directly downstream of the holding and/or correction to the reference state. In practice, on account of the presence of some equipment or a work station necessary for example for the laying of the ties 107 before their fastening (screws and/or clips) by a work station 108, it will be ensured that the distance separating a zone Z4 of the work train in which the step of fastening of the new long rail is performed from the zone Z3 of the work train in which the step of holding and/or correction of the reference state is performed, i.e. less than 7 m.

During said second phase B, initial and final phases must be implemented in order to initiate and finalize the laying of the new long rails 22, at the same time as the dismantling of the old rails 21 with respect to the pre-existing railway track to which its connection must be ensured.

In order to achieve this, the second phase B comprises an initial phase, illustrated in detail in FIGS. 5A, 5B, 5C, 5D, 5E and 5F. In these figures, only the first and second vehicles 131 and 132 of the works train 130 are illustrated, in order to simplify the views. In an initial configuration, the old rails 21 extend continuously and are fastened to the sleepers 23 by ties (not shown), while the new long rails 22 are laid along the railway track (see FIG. 5A). The initial phase corresponds to the engagement of the steps of laying the new long rails 22 and dismantling the old rails 21 by the work train 100, in order to start the replacement, proceeding from this initial configuration. Said initial phase comprises in particular, but not exclusively, the following steps, preferably for each of the two parallel rails in the same region of the railway track 20:

a step of dismantling the ties fastening the old rails in the vicinity of and downstream of the rails to be replaced, i.e. on a portion located downstream of an end 211' of an old joining rail 211 to which an end portion 221' of a first of the new long rails 221, with respect to the second direction of travel F2 (see FIG. 5B), has to be connected: said step of dismantling the ties is implemented by dismantling means 102 preferably located in the region of the third upstream vehicle 133 of the works train 130 in said direction of travel F2 when it is used or can be implemented also upstream of the vehicle 132 implementing the neutralizing step;

a step of heating or cooling for neutralizing the end portion 211' of the old joining rail 211 downstream of the end 211' thereof to which the end portion 221' of the first new long rails 221, with respect to the second direction of travel F2 (see FIG. 5B), has to be connected, the end portion 211' comprising the end 211' of the old joining rail 211 to which the end portion 221' of the first new long rail has to be connected: said heating or cooling step is preferably implemented by the holding and/or correction means 113, 114, 112 for the reference temperature, rather than by the neutralizing heating or cooling means 111. Said heat transfer or insulation means are borne in part (112) by the second vehicle 132 coupled in front of the first vehicle 131 and located downstream of the works train 130 in said direction of travel F2;

a step of cutting the old rail 21, in particular the old joining rail 211 (see FIG. 5C), thus creating a discontinuity of the railway track 20 in a position when the discontinuity of the railway track 20 is spanned by the vehicle 132 performing the neutralizing heating or cooling, the dismantling of the old rails 21 and the laying of the new long rails 22 as the train travels according to the direction of travel F2;

a step of heating or cooling for neutralizing the end portion 221' of the first new long rail 221 comprising the end 221' to which the end 211' of the old joining rail 211 has to be connected;

after laying of at least a portion of at least the first new long rail 221 on the sleepers 23 at the end 211' of the old joining rail 211, a step of temporary end-to-end connection of the end 211' of the old joining rail 211 to the end 221' of the first new long rail 221 by a temporary connection device 30 such as a fishplate or a rail driftpin (see FIG. 5D), ensuring the passage of the bogies 101 and making it possible to retain an end-to-end and ideally neutral position, despite possible outside temperature variations;

when the work train 100 has passed the temporary connection device 30, a step of permanent connection, for example welding, preferably thermite welding, of the two connected ends 211', 221', followed by a step of removal of the temporary connection device 30.

In a particular configuration, the heating or the cooling of the end portion 211' of the old joining rail 211 upstream of the end 211' thereof before the cutting of the rail can be ensured by the at least one neutralizing heating or cooling means 111, and/or by all or some of the holding and/or correction means 112, 113, 114 of the reference temperature. In this latter case, the neutralizing heating or cooling means 111 can preferably be activated only from the step of neutralizing the end portion 221' of the first of the new long rails 221 to the reference temperature. The advantage of using only all or some of the holding and/or correction means 112, 113, 114 of the reference temperature is that at this location the old joining rails 211 are laid on the sleepers 23, and the use of neutralizing means 111 such as induction heating could damage the ties of the old rails which, like the rails, are also metal. The heating for holding and/or correction 112, 113, 114 is less powerful than the induction heating 111 and prevents damage to the ties. This is easier to implement than using a power variation means for the neutralizing means 111, in particular induction heating means, which would make the equipment more expensive and more complex. The heating or cooling of the end portion 211' of the old joining rail 211 is preferably carried out over a distance greater than the zone on which the ties are dismantled (see FIG. 5B).

The second phase B also comprises a final phase corresponding to the disengagement of the steps of laying the new long rails 22 and dismantling the old rails 21 by the work train 100, in order to finalize the replacement. Said final phase is illustrated in detail in FIGS. 6A, 6B, 6C, 6D, 6E and 6F, and comprises in particular, but not exclusively, the following steps, preferably for each of the two parallel rails in the same region of the railway track 20:

- a step of heating or cooling for neutralizing, to the reference temperature, an end portion 222' of a last of the new long rails 222, the end portion comprising the end 222' of the last new long rail 222 to which the old railway track 20 has to be connected (see FIG. 6B);
- a step of cutting the old rail 21, defining an end 212' of an old joining rail 212 (see FIG. 60);
- a step of temporary end-to-end connection of the end 222' of the last new long rail 222 to the end 212' of the corresponding old joining rail 212 by at least one temporary connection device 30 such as a fishplate or a rail driftpin (see FIG. 6D) which allows the rails to either stretch freely but not to retract in the case of use of heating, or to retract freely but not to stretch in the case of use of cooling, and thus to maintain a neutral position despite possible outside temperature variations;
- a step of heating or cooling for neutralizing an end portion 212' of the old joining rail 212 located upstream of its end 212' to which the end portion 222' of the last new long rail 222, with respect to the second direction of travel F2, has to be connected (see FIG. 6D), the end portion 212' of the old joining rail 212 comprising the end 212' of the old joining rail to which the end portion of the last new long rail 222 has to be connected: said step of heating or cooling is preferably implemented by the holding and/or correction means 113, 114, 112 of the reference temperature, rather than by the neutralizing heating or cooling means 111, the heating or cooling of the end portion 212' of the old joining rail 212 preferably being carried out over a distance greater than the zone on which the ties are dismantled (see FIG. 6E);
- when the work train 100 has passed the temporary connection device 30, a step of permanent connection, for example welding, for example thermite welding, of the two connected ends 212', 222' followed by a step of removal of the temporary connection device 30.

During the entire progression of the work train 130, according to the second direction of travel F2:

- a work station 102 arranged on a front part of the works train 130, in this case upstream of the third vehicle 133 in the direction of travel F2, is designed to remove the ties of the rails which fastens them to the sleepers 23 such that a detached portion P1 of the railway track 20 is no longer fastened by the ties;
- a work station 103, borne by the third vehicle 133 and arranged downstream of the work station 102 for removing the ties, is designed to collect the removed ties;
- a work station 104, borne by the second vehicle 132 and arranged downstream of the work station 103 for collecting ties, is designed to dismantle old tie pads, generally made of rubber, which are located between the sleeper and the bottom of the rail, said tie pads having the role of damping some of the vibrations and allowing the longitudinal progress of the rail without damaging the sleeper 23;
- a work station 105, borne by the second vehicle 132 and arranged downstream of the work station 104 for dismantling old tie pads and upstream of the neutralizing means 111, is designed for depositing new tie pads on the sleepers 23 on which the new long rails 22 will come to rest;
- a work station 106, borne by the first vehicle 131 and arranged downstream of holding and/or correction means 113 for the reference temperature located in the region of the zone Z3, is designed for collecting the old tie pads dismantled by the work station 104;
- a work station 107, borne by the first vehicle 131 and arranged downstream of the work station 106 for collecting old tie pads, designed for placing the ties; and
- a work station 108, bone by the first vehicle 131 and arranged downstream of the work station 107 for placing the ties, designed for fastening the rail ties and thus fastening said rails to the sleepers 23, such that an attached portion P2 of the railway track 20 is blocked by the ties.

In this way, a new rail is neutralized in a detached state, Of course, these work stations can be substantially shifted. As described, in a configuration comprising a third car 133, it is this car 133 which can ensure the removal of the rail ties. A step of collecting the ties is then preferably implemented directly after their removal. The new long rails 22 are, in turn, attached either using new ties or using old ties previously removed and then collected, in order to ensure recycling of the ties if their state allows this.

It will be noted that "work station" means any work station making it possible to receive people for performing manual operations, and/or any equipment intended for performing these operations in an automatic or semi-automatic manner.

Furthermore, during said second phase B, the removal of the ties, and thus the subsequent blocking of the ties, is implemented proceeding from a downstream portion at the end 211' of the old joining rail 211 comprising the end 211' to which the end 221' of the first new long rail 221 has to be connected, and extends as far as an upstream portion at the end 212' of the old joining rail 212 comprising the end 212' to which the end 222' of the last new long rail 222, with reference to the second direction of travel F2, has to be connected. In this way, the laying of new long rails is carried out at a reference temperature, said laying being followed by operations aiming to subsequently fasten it in accordance with the predetermined reference temperature.

Figure 7:
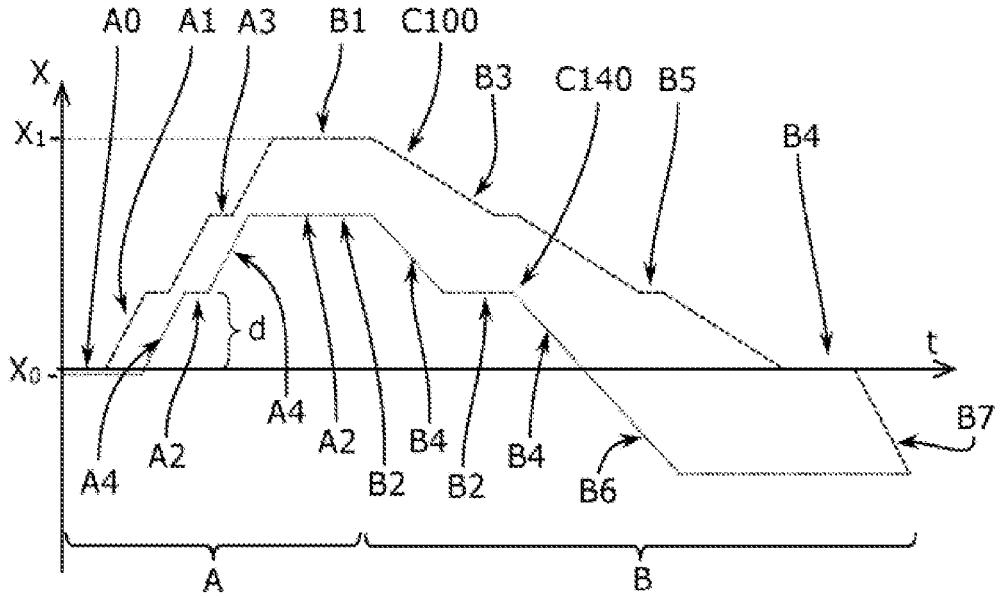
FIG. 7 is a graph illustrating the operation of the work train according to its movement along the railway track.

FIG. 7 is a graph illustrating the operation of the rail convoy 10, in particular its progression along the railway track 20, the x axis showing the time progression during the work, and the y axis showing the position with respect to the railway track 20. A first curve C100, here the top curve, corresponds to the progression of the work train 100, and a second curve C140, below the curve C100, corresponds to the progression of the rail vehicle 140 travelling independently and at a distance d from the work train 100.

During the first phase A, the work train 100 moves from a starting position X0 as far as an end position X1, along the railway track 20, During this movement according to the first direction of travel F1, the work train 100 alternates dynamic steps A1, of unloading new long rails 22 along the railway track 20, and static steps A3, marking stages during which each new long rail is engaged in guide tunnels for the work train in order to ensure the correct unloading of these new long rails 22 along the railway track 20.

In parallel with the progression of the work train 100, the rail vehicle 140 progresses in stages, alternating static steps A2 of preparation for welding, and dynamic steps A4 of movement from one abutting end of two new long rails to another abutting end, according to the first direction of travel F1.

Following the first phase A the second phase B continues, during which the work train 100 moves from the end position X1 as far as the starting position X0, along the railway track 20. During this movement according to the second direction of travel F2, the work train 100 alternates between dynamic steps B3 of loading old rails 21 onto the transport train 120, and static steps B5 marking stages during which the old rail 21 is cut during its loading, such that it can be stored in a plurality of basic sections, on the transport train 120.

In an embodiment of this kind, tests have shown that the work train 100 could progress at a speed of 2500 m/h during the first phase A, and at a speed of 600 m/h during the second phase B, while being able to progress according to working radii of 250 m and on gradients of 40%. Such a method according to the invention also offers the advantage of being able to be implemented, if required, while leaving free possible adjacent railway tracks which can thus be travelled on entirely safely.

In parallel with the progression of the work train 100 during said second phase B, the rail vehicle 140 progresses in stages, alternating steps B2 of welding and steps B4 of movement from one abutting end of two new long rails to another, according to the second direction of travel F2. The steps B6 and B7 mark a movement of the welding machine 140 and of the work train 100, respectively, in the continuation of its progression and beyond the starting position X0, in order to ensure the welding between the two connected ends 212', 222' at the end of the work. The initial phases B1 (FIGS. 5A to 5F) and final phases B4 (FIGS. 6A to 6F) of the second phase B are indicated by stages, which is a simplification given the very low speed of movement of the work train 100 during these two phases A and B. Furthermore, such a method makes it possible to easily and relatively rapidly implement the electric welding operations of the LWR rails, the dismantling and the re-mounting of the rail ties, and the neutralizing of the rails.

Of course, the invention is described above by way of example. It will be understood that a person skilled in the art is able to implement different variants of the invention without in any way departing from the scope of the invention.

For example, the composition of the work train may be different. The works train may comprise just two cars, as shown in FIGS. 5 and 6, or three cars as shown in FIGS. 1, 2, 3 and 4. More precisely, it is possible to design the work train so as to work without the third work vehicle 133 of the work train 130. In such a design, the ties of the old track could be dismantled using manual tools, upstream of the rail convoy, with reference to the second direction of travel F2.

Furthermore, the rails can be replaced in parallel, two-by-two, so as to replace all the railway track during the operations, and/or successively along one side only of the railway track, so as to replace the rails of a single line. Indeed, it can be envisaged that only successive rails of one single side of the railway track will be replaced, which may be of interest on sections of railway track such as curved sections. In other words, the initial and/or final laying methods may be implemented, as for the replacement, on a line of rails of the railway track, or indeed concurrently on the two parallel lines of rails of the railway track.

In an alternative or additional design, the neutralizing can be achieved other than by heating or cooling, by mechanical stresses likely to cause portions of rails to be stretched in a manner corresponding to their expansion at said reference temperature. The reference state thus corresponds to an expansion state given by way of reference, which itself corresponds to a state of the rail portion if it were exposed to said reference temperature.

It can also be envisaged that the first and second phases A and B are implemented in a temporally spaced manner, it being possible for the first phase A to be implemented one night, and the second phase B to be implemented a following night.

Regarding the dismantling of the old rails, in place of being loaded onto the transport train the old rails could also be unloaded along the railway track from their position laid on the sleepers.

The bogies can also be formed by any type of wheel set.

Such a rail convoy is of particular interest in that it allows for replacement of a railway track which offers the shortest possible immobilization of the railway track in order to reduce the duration of the work, while ensuring good safety of the laid railway track. Of course, it is also possible to use a rail convoy of this kind for operations which do not involve all the steps. The rail convoy can be used to simply transport and unload the new long rails along the railway track from the transport train, either outside of the railway track or inside, with an optional operation of welding and placement of roller supports.

It is emphasized that all the features, as they follow for a person skilled in the art from the present description, the drawings, and the accompanying claims, even if they have been specifically described only in relation with other specific features, both individually and in any combination, can be combined with other features or groups of features disclosed herein, provided that this is not explicitly excluded or that technical circumstances render such combinations impossible or meaningless.

The invention claimed is:

1. A method for laying new long rails of a railway track by means of a work train travelling in a direction of travel, the method comprising replacing old rails of the railway track with new long rails, wherein the new long rails are laid and subsequently fastened to a fixed structure of the railway track when the work train is travelling in said direction of travel, the laying method comprising:

a step of laying at least one portion of a first of the new long rails on the fixed structure at at least one end of an old joining rail;

a temporary end-to-end connection step for connecting the end of the old joining rail to at least one end of the first new long rail by means of at least one temporary connection device;

a step of permanent connection of two connected ends of the old joining rail and the first new long rail;

the laying method comprising, prior to the laying step, a step of heating or cooling, for neutralizing to ua reference temperature, at least one end portion of the first new long rail, the end portion comprising the end of the first new long rail to which the end of the old joining rail is required to be connected.

2. The Initial method for laying rails according to claim 1, wherein, it comprises a step of neutralizing, by heating or cooling, an end portion of the old joining rail comprising the end of the old joining rail to which the end portion of the first new long rail is required to be connected.

3. The method for laying rails according to claim 1, wherein the step of heating or cooling for neutralizing the end portion of the old joining rail is performed by heat transfer or insulation means comprising an infrared radiation source for heating said end portion of the old joining rail to the reference temperature.

4. The method for laying rails according to claim 1, wherein, prior to the step of temporary end-to-end connection of the end of the old joining rail to the end of the first new long rail by the temporary connection device, a step of cutting the old joining rail is performed in order to form the end of the old joining rail which is to be connected.

5. The method for laying rails according to claim 1, wherein the temporary connection device is selected from the group consisting of a fishplate, a rail driftpin, and combinations thereof.

6. The method for laying rails according to claim 1, wherein, prior to or following the step of temporary end-to-end connection of the end of the old joining rail to the end of the first new long rail by the temporary connection device, said ends undergoing a preparation step of abrasive machining.

7. A method for laying new long rails of a railway track by means of a work train travelling in a direction of travel, the method being intended to be implemented during a process for replacing old rails of the railway track wherein the new long rails are laid and subsequently fastened to a fixed structure of the railway track when the work train is travelling in said direction of travel, the laying method comprising:

a step of laying at least one portion of a last of the new long rails on the fixed structure at at least one end of an old joining rail;

a temporary end-to-end connection step for connecting an end of the last new long rail to at least the end of the old joining rail by means of at least one temporary connection device;

a step of permanent connection of two connected ends of the old joining rail and the last new long rail;

the laying method comprising, prior to the laying step, a step of heating or cooling, for neutralizing to a reference temperature, at least one end portion of the last new long rail, the end portion comprising the end of the last new long rail to which the end of the old joining rail is to be connected.

8. The method according to claim 7, wherein it comprises a step of neutralizing, by heating or cooling, an end portion of the old joining rail comprising the end of the old joining rail to which the end portion of the last new long rail is to be connected.

9. A method for replacing old rails of a railway track during which the new long rails are laid and subsequently fastened to a fixed structure of the railway track by a work train travelling in a direction of travel, the replacement method being characterized in that a phase is initiated by the method for laying new long rails according to claim 1, and/or finalized by a method for laying new long rails.

* * * * *